US009785122B2

(12) United States Patent
Mininger et al.

(10) Patent No.: US 9,785,122 B2
(45) Date of Patent: Oct. 10, 2017

(54) ALARM CLOCK WITH CHARGING PORTS

(71) Applicant: TXS Industrial Design, Inc., Richardson, TX (US)

(72) Inventors: Staci A. Mininger, Garland, TX (US); Timothy W. Terleski, Richardson, TX (US)

(73) Assignee: TXS Industrial Design, Inc., Richardson, TX (US)

( * ) Notice: Subject to any disclaimer, the term of this patent is extended or adjusted under 35 U.S.C. 154(b) by 38 days.

(21) Appl. No.: 14/570,018

(22) Filed: Dec. 15, 2014

(65) Prior Publication Data

US 2016/0170381 A1 Jun. 16, 2016

(51) Int. Cl.

| | |
|---|---|
| ***G04G 13/02*** | (2006.01) |
| ***G04G 17/06*** | (2006.01) |
| ***G04G 9/00*** | (2006.01) |
| ***G04G 17/08*** | (2006.01) |
| ***G04G 21/00*** | (2010.01) |

(52) U.S. Cl.

CPC ..... *G04G 17/06* (2013.01); *G04G 9/00* (2013.01); *G04G 13/021* (2013.01); *G04G 13/025* (2013.01); *G04G 13/026* (2013.01); *G04G 17/086* (2013.01); *G04G 21/00* (2013.01)

(58) Field of Classification Search

CPC ..... G04C 17/00; G04G 21/00; G04G 13/021; G04G 17/086; G04G 9/00; G04G 17/06

See application file for complete search history.

(56) References Cited

U.S. PATENT DOCUMENTS

| | | | | |
|---|---|---|---|---|
| 8,593,912 | B1 * | 11/2013 | Amores | G04G 11/00 368/239 |
| 2006/0280035 | A1 * | 12/2006 | Walker | A61J 7/0481 368/10 |
| 2008/0123472 | A1 * | 5/2008 | Bart | G04G 21/00 368/10 |
| 2009/0285056 | A1 * | 11/2009 | Scott | G04G 9/0076 368/21 |
| 2012/0299487 | A1 * | 11/2012 | Chen | H05B 37/0218 315/154 |
| 2014/0269222 | A1 * | 9/2014 | Patton | G04G 15/00 368/73 |

* cited by examiner

*Primary Examiner* — Sean Kayes
(74) *Attorney, Agent, or Firm* — Boisbrun Hofman, PLLC

(57) ABSTRACT

An alarm clock is provided that has a housing, one or more charging ports, an audio transducer, an alarm control device, a display, and a controller. The charging ports are mounted in a surface of the housing and provide power from a power supply to an external device. The controller receives input signals from the alarm control device and sends output signals to the audio transducer and the display. When the controller receives input signals from the alarm control device, it responds by displaying and setting a desired alarm time on the display, and by arming an alarm function. While the alarm function is armed, if a current time matches the alarm time, the controller causes the audio transducer to emit an alarm sound. When the controller receives another input signal from the alarm control device, it responds by taking the alarm time off the display, disarming the alarm function, and, if the alarm sound is being emitted, quieting the alarm sound. The alarm function remains disarmed until the controller receives yet another input signal from the alarm control device, and in response rearms the alarm function.

5 Claims, 7 Drawing Sheets

ALARM CLOCK WITH CHARGING PORTS

TECHNICAL FIELD OF THE INVENTION

The present application relates generally to alarm clocks and, more specifically, to an alarm clock with charging ports.

BACKGROUND OF THE INVENTION

Alarm clocks are familiar consumer products, however conventional alarm clocks do not meet all the needs of guests when the alarm clocks are used in hotel rooms.

SUMMARY OF THE INVENTION

In accordance with a first aspect of the present invention, there is provided an alarm clock having a housing, one or more charging ports, an audio transducer, an alarm control device, a display, and a controller. The charging ports are mounted in a surface of the housing, are electrically coupled to a power supply, and provide power to an external device electrically coupled to the charging port. The controller is electrically coupled to the audio transducer, the alarm control device, and the display and receives input signals from the alarm control device and sends output signals to the audio transducer and the display.

When the controller receives a first plurality of input signals from the alarm control device, it responds by displaying and setting a desired alarm time on the display, and by arming an alarm function. While the alarm function is armed, if a current time matches the desired alarm time the controller causes the audio transducer to emit an alarm sound. When the controller receives a second input signal from the alarm control device, it responds by taking the alarm time off the display, disarming the alarm function, and, if the alarm sound is being emitted, quieting the alarm sound. The alarm function remains disarmed until the controller receives a third input signal from the alarm control device, and in response rearms the alarm function.

In accordance with a second aspect of the present invention, there is provided an alarm clock having a housing, one or more charging ports mounted in an upper surface of the housing, one or more drain apertures formed in a lower surface of the housing, an alarm control device, a display, and a controller. The charging ports are electrically coupled to a power supply, and provide power to an external device that is electrically coupled to the charging port. The alarm control device includes first and second input devices. The controller is electrically coupled to the alarm control device and the display and receives input signals from the alarm control device and sends output signals to the display. The drain apertures allow liquid that enters the housing through the charging ports to drain away, so that the liquid does not form an electrical short-circuit between electrical connectors that are associated with the one or more charging ports.

When the controller receives a first activation of the first input device, it enters an alarm-setting mode. In the alarm-setting mode, the controller displays a desired alarm time on the display and adjusts the desired alarm time in response to activation of the second input device. When the controller receives a second activation of the first input device, it arms an alarm mode. While the alarm function is armed, if a current time matches the desired alarm time the controller causes the audio transducer to emit an alarm sound. When the controller receives a third activation of the first input device, it responds by taking the alarm time off the display, disarming the alarm function, and, if the alarm sound is being emitted, quieting the alarm sound. The alarm function remains disarmed until the controller receives a subsequent activation of the first input device, and in response rearms the alarm function.

In accordance with a third aspect of the present invention, there is provided an alarm clock having a housing, one or more charging ports, a brightness switch, an audio transducer, an alarm control device, a display, and a controller. The charging ports are mounted in a surface of the housing, are electrically coupled to a power supply, and provide power to an external device electrically coupled to the charging port. The controller is electrically coupled to the audio transducer, the alarm control device, and the display and receives input signals from the alarm control device and sends output signals to the audio transducer and the display. When the controller receives input signals from the alarm control device, it sets a desired alarm time, arms an alarm function, or disarms the alarm function. The alarm function remains disarmed until the controller receives a subsequent input signal from the alarm control device, and in response rearms the alarm function. When the controller receives input signals from the brightness switch, it sets a brightness of the display, including turning off the display. While the alarm function is armed, if a current time matches the desired alarm time the controller causes the audio transducer to emit an alarm sound and, if the display is turned off, turn on the display.

Other technical features may be readily apparent to one skilled in the art from the following figures, descriptions and claims.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely. Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

FIGS. 1 through 8, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged apparatus for an alarm clock with charging ports.

The present disclosure relates to an alarm clock with charging ports, where, in various embodiments, the alarm function can be controlled from an alarm control device; the same alarm control device can be used to set the current date and time; a brightness switch can change brightness of the display, including turning the display off; and the alarm clock includes a Bluetooth-compatible speaker for use with an external audio source.

Figure 1:
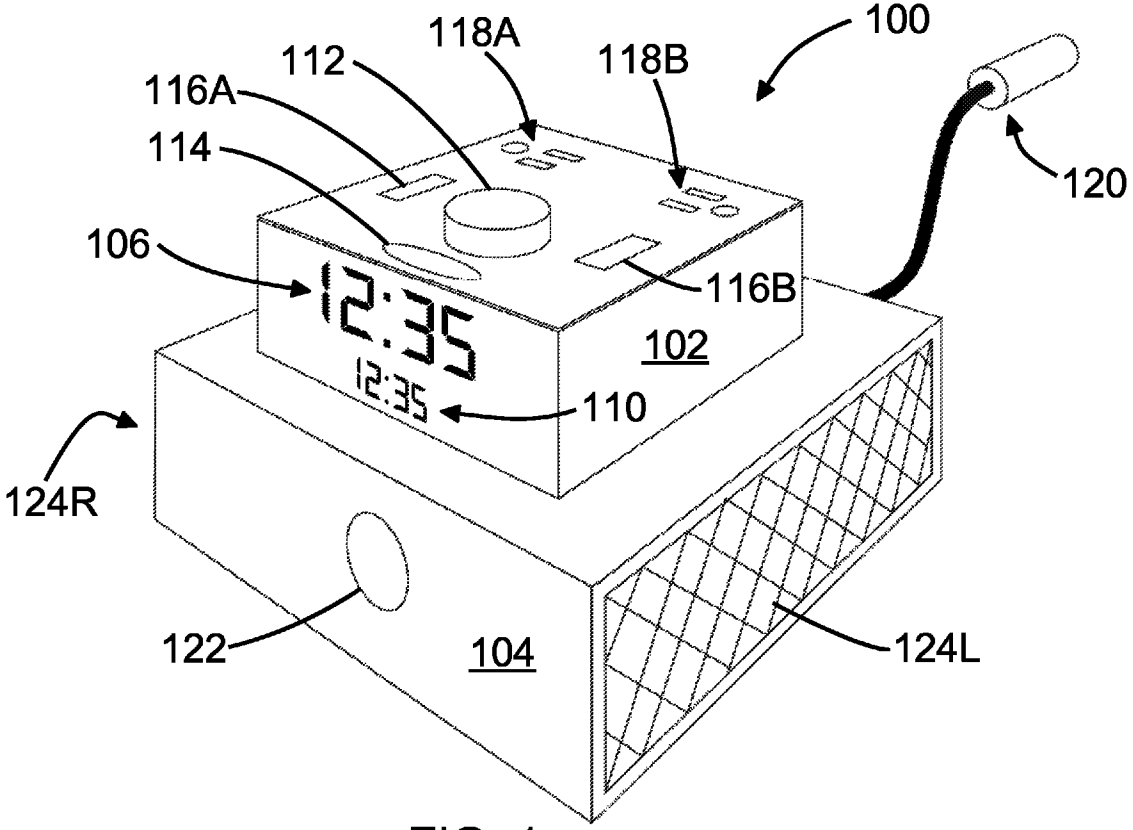
FIG. 1 presents an isometric view of an alarm clock with charging ports according to an exemplary embodiment of the disclosure.

FIG. 1 presents an isometric view of an alarm clock 100 with charging ports according to an exemplary embodiment of the disclosure. The alarm clock 100 includes an upper body portion 102. The upper body portion 102 includes a current time display 106 and an alarm time display 110. The upper body portion 102 further includes a control knob 112 and a brightness switch 114. The control knob 112 comprises a switch that responds to vertical or lateral pressure on the control knob 112 and a rotary position sensor that responds to rotation of the control knob 112. The upper body portion 102 further includes an audio transducer (not shown) configured to emit an alarm sound.

The control knob 112 is an alarm control device that controls the alarm functionality of the alarm clock 100 as well as other functions, as will be described in more detail below.

The upper body portion 102 also includes USB charging ports 116A and 116B and line voltage charging ports 118A and 118B. The upper body portion 102 further includes a DST switch (not shown in FIG. 1) to enable or disable automatic switching of the alarm clock 100 into and out of daylight savings time mode, based upon the current date. The upper body portion further includes a power cord and connector 120 to provide line voltage power to the alarm clock 100.

In various embodiments, the power cord and connector 120, as well as the line voltage charging ports 118A and 118B, may be adapted to the voltage and connector configurations of any national or international line power standards.

The alarm clock 100 may optionally also include a lower body portion 104. The lower body portion 104 includes a speaker system adapted for wireless connectivity to a portable music source (not shown). The lower body portion 104 comprises a "pairing" button 122 and speakers 124L and 124R. Speaker 124R is not visible in FIG. 1.

Operation of the brightness switch 114 and the control knob 112 are described below with reference to FIGS. 3, 4, and 5. While the upper body portion 102 comprises two USB charging ports 116A and 116B, it will be understood that, in other embodiments, the alarm clock 100 may include any number of USB charging ports, including no USB charging ports. Similarly, while the upper body portion 102 comprises two line voltage charging ports 118A and 118B, it will be understood that, in other embodiments, the alarm clock 100 may include any number of line voltage charging ports, including no line voltage charging ports. While the lower body portion 104 includes speakers 124L and 124R, it will be understood that, in other embodiments, the alarm clock 100 may include any number of speakers.

Figure 2:
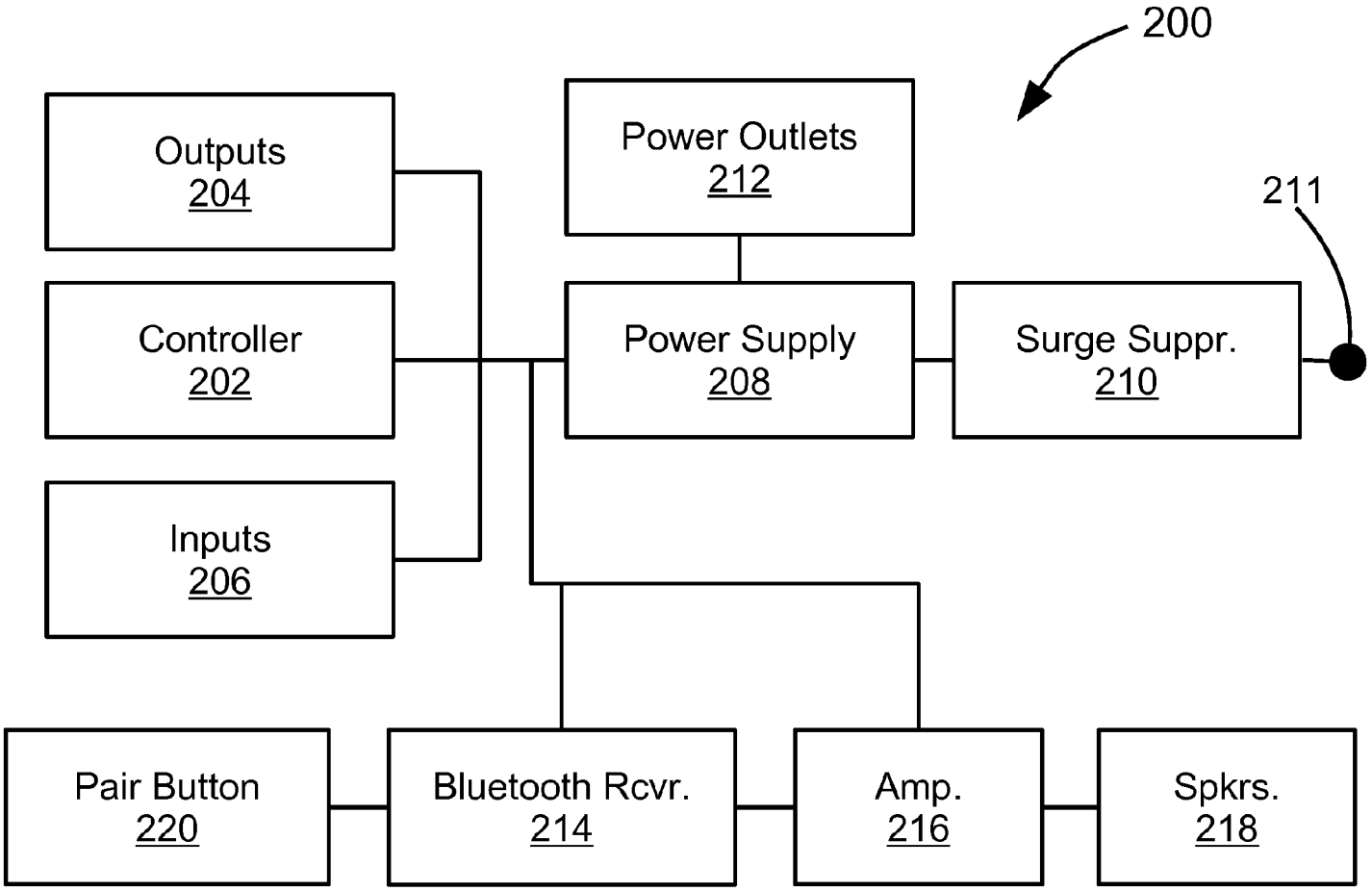
FIG. 2 presents a schematic block diagram of an alarm clock with charging ports according to an exemplary embodiment of the disclosure.

FIG. 2 presents a schematic block diagram of an alarm clock 200 with charging ports according to an exemplary embodiment of the disclosure. The alarm clock 200 includes a controller 202. The controller 202 may be any suitable processing device, such as a microprocessor, microcontroller, programmable gate array (PGA), application-specific integrated circuit (ASIC), or the like. The controller 202 includes memory comprising any suitable combination of volatile and/or non-volatile storage and retrieval device or devices. The memory of the controller 202 may store data and instructions adapted to be used by the controller 202 to control the various elements of the alarm clock 200.

The alarm clock 200 also includes outputs 204 and inputs 206. The outputs 204 and the inputs 206 are communicatively coupled to the controller 202. The outputs 204 may be configured using any suitable output technology and associated interface and driver circuits. In some embodiments, the displays 204 include the current time display 106, the alarm time display 110, and the audio transducer of the alarm clock 100 described with reference to FIG. 1. In such embodiments, the controller 202 is configured to send output signals to the displays 106 and 110 to show desired information on the displays 106 and 110, as well as to send output signals to the audio transducer to emit sounds such as an alarm sound.

The inputs 206 may be configured using any suitable physical devices and input technology, along with associated interface and driver circuits. In some embodiments, the inputs 206 include physical devices and circuits associated with the control knob 112 and the brightness switch 114. In such embodiments, the controller 202 is configured to receive signals indicating activation of the brightness switch 114, closure of the switch associated with the control knob 112, and changes in position detected by the rotary position sensor associated with the control knob 112.

The alarm clock 200 is powered by a power supply 208, which is electrically coupled to, and adapted to provide one or more voltages to, circuits of the alarm clock 200. The power supply 208 is electrically coupled to power outlets 212. The power outlets 212 are any suitable connectors for providing charging or other operational power to external devices. In some embodiments, the power outlets 212 include one or both of the USB charging ports 116A and 116B and the line voltage charging ports 118A and 118B described with reference to FIG. 1. In such embodiments, the power supply is configured to provide low voltage (5V or five volt) DC power to the USB charging ports 116A and 116B and line voltage AC power to the line voltage charging ports 118A and 118B.

The power supply 208 receives input power from a terminal 211 via a surge suppressor 210. The terminal 211 may be electrically coupled to an input power connector such as connector 120 described with reference to FIG. 1. The surge suppressor 210 is adapted to reduce or prevent the impact on the circuits of the alarm clock 200, as well as external devices plugged into the power outlets 212, of surges or other potentially harmful variations in the input power received via the terminal 211.

In some embodiments, the alarm clock 200 further includes elements associated with a speaker system adapted for wireless connectivity to a music player or other external audio source, including elements associated with the lower body portion 104 described with reference to FIG. 1. In such embodiments, the alarm clock 200 includes a Bluetooth-compatible receiver 214, electrically coupled to an audio amplifier 216, which is electrically coupled to one or more speakers 218. The receiver 214 is further electrically coupled to a so-called "pairing" button 220. The receiver 214 and the amplifier 216 are further electrically coupled to and receive power from the power supply 208.

When a user of the alarm clock 200 has a Bluetooth-compatible external audio source, the user may operate the external audio source to place it in a mode where it is available for pairing with other Bluetooth-compatible devices. If the user then activates the pairing button 220, the receiver 214 is adapted to respond by performing a pairing procedure with the external audio source. Upon completion of the pairing procedure, the receiver 214 will be operable to receive audio signals transmitted via Bluetooth from the external audio source and play the received audio signals via the amplifier 216 and the speakers 218.

Figure 3:
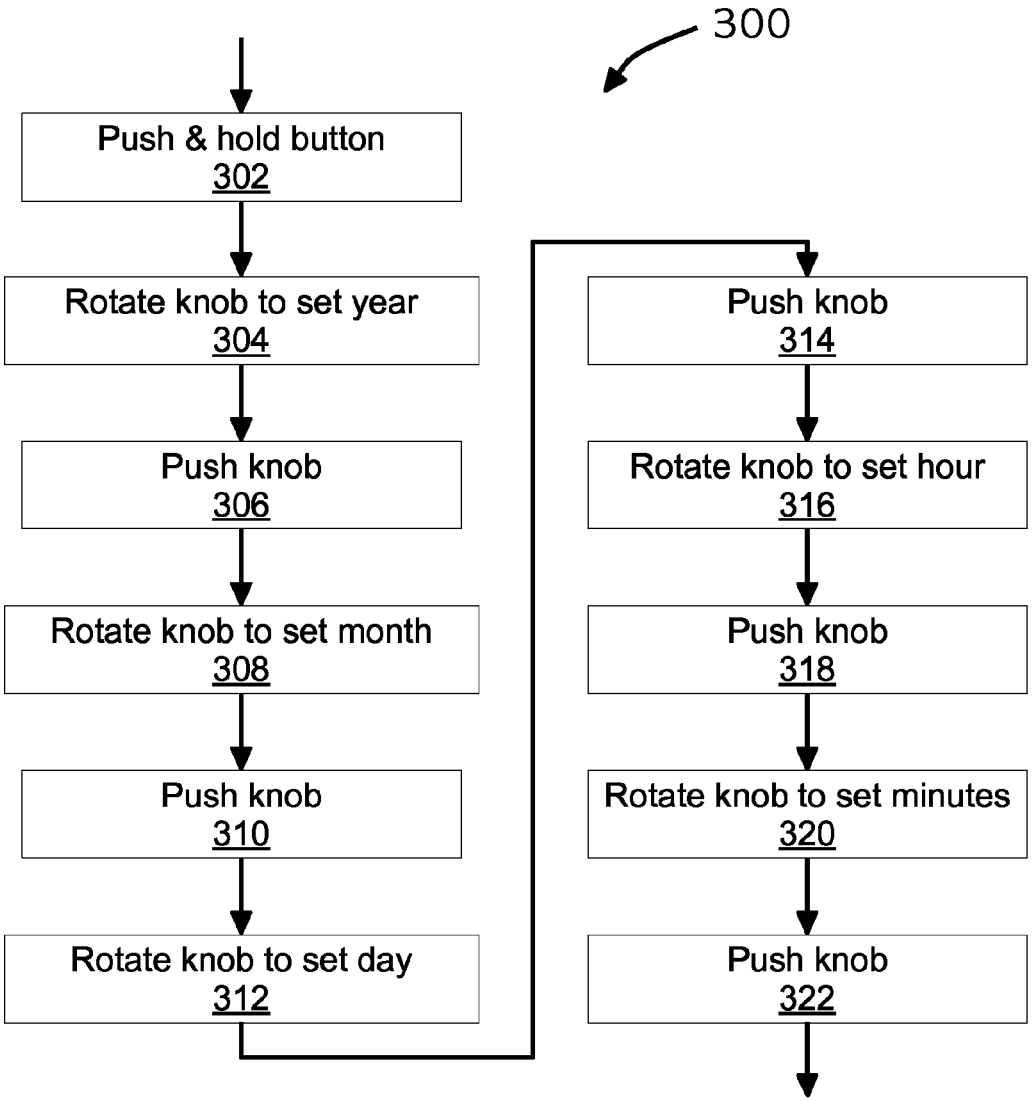
FIG. 3 presents a procedure for date and time setting functionality of an alarm clock with charging ports according to an exemplary embodiment of the disclosure.

FIG. 3 presents a procedure 300 for date and time setting functionality of an alarm clock with charging ports according to an exemplary embodiment of the disclosure. Describing, as an example, operation of the alarm clock 100 described with reference to FIG. 1, from what might be termed 'normal' operation: e.g., displaying the current time, in step 302, a user presses and holds brightness switch 114 for at least a predetermined amount of time: e.g., 6 seconds. If the brightness switch 114 is not held for the predetermined amount of time, further operation of the alarm clock 100 is described with reference to FIG. 4 or 5.

If the brightness switch 114 is held for the predetermined amount of time, the alarm clock 100 enters a first phase of date-setting mode. In this first phase, in step 304, the user may rotate the control knob 112 to set a desired year of the current date. Once the desired year has been set, the user presses the control knob 112 in step 306 to enter a second phase of the date-setting mode. In this second phase, in step 308, the user may rotate the control knob 112 to set a desired month of the current date. Once the desired month has been set, the user presses the control knob 112 in step 310 to enter a third phase of the date-setting mode. In this third phase, in step 312, the user may rotate the control knob 112 to set a desired day of the month of the current date.

Once the desired day of the month has been set, the user presses the control knob 112 in step 314 to enter a first phase of a time-setting mode. In step 316, the user may rotate the control knob 112 to set a desired current hour. Once the desired hour has been set, the user presses the control knob 112 in step 318 to enter a second phase of the time-setting mode. In step 320, the user may rotate the control knob 112 to set a desired current minutes. In step 322, the user presses the control knob 112 to return to normal operation.

The current date is used in conjunction with the DST switch described with reference to FIG. 1 to change the current time if the alarm clock 100 switches into or out of daylight savings time on the appropriate dates of the year. In some embodiments, the current date may be displayed in one or the other of the current time display 106 or the alarm time display 110.

Figure 4:
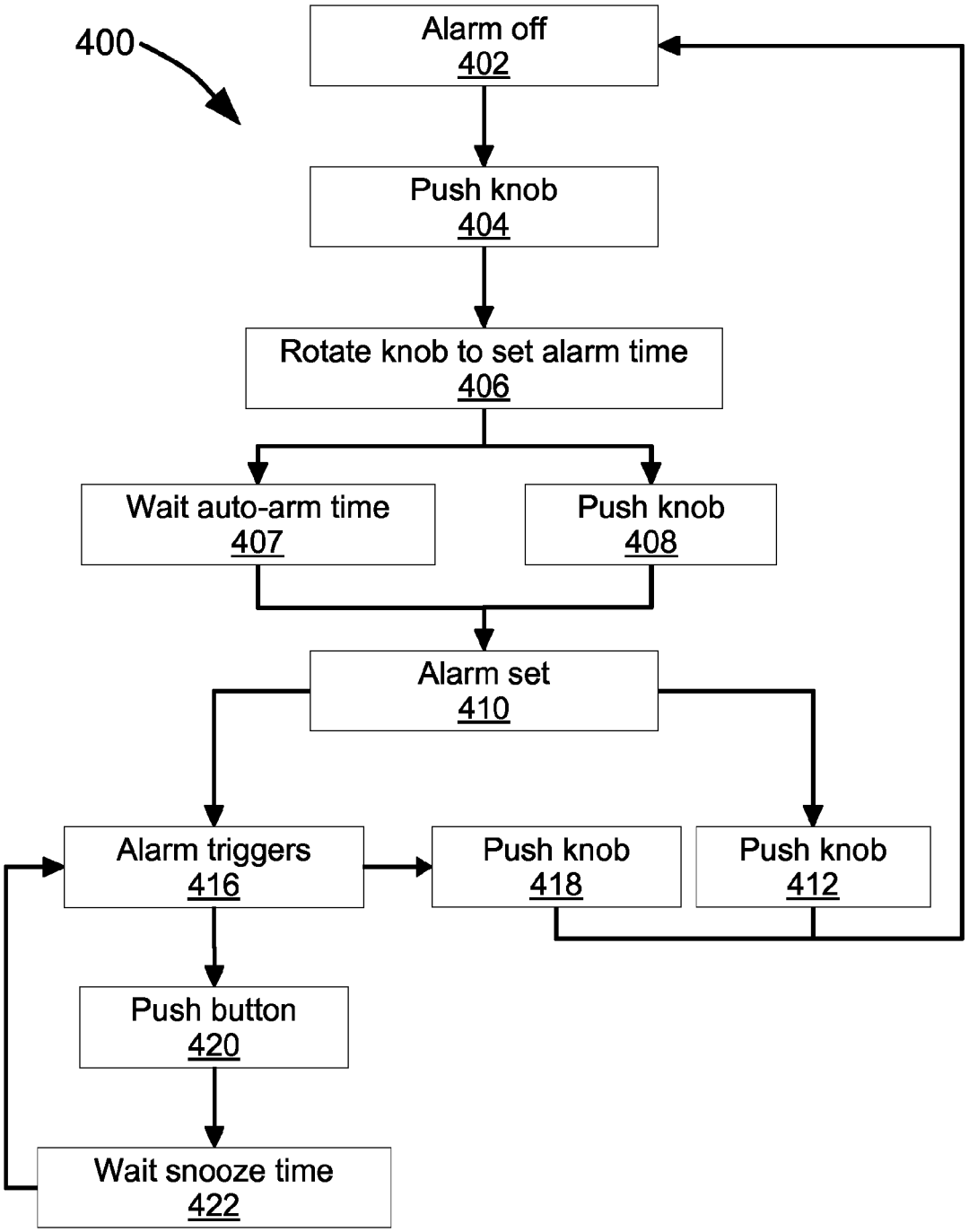
FIG. 4 illustrates a procedure for alarm functionality of an alarm clock with charging ports according to an exemplary embodiment of the disclosure.

FIG. 4 illustrates a procedure 400 for alarm functionality of an alarm clock with charging ports according to an exemplary embodiment of the disclosure. Using operation of the alarm clock 100 described with reference to FIG. 1 again as an example, in step (or state) 402, the alarm function of the alarm clock 100 is switched off. While the alarm function is switched off, the alarm time display 110 displays the word "OFF".

In step 404, the user pushes the control knob 112 briefly to place the alarm clock 100 into an alarm-setting mode. In this mode, the current setting of the alarm time is displayed as flashing digits in the alarm time display 110. In step 406, the user may rotate the control knob 112 to set a desired alarm time. Once the desired alarm time is displayed in the alarm time display 110, the procedure 400 may proceed to either step 407 or step 408.

In step 408, the user presses the control knob 112 to set (or arm) the alarm function and fix the current alarm time. While the alarm function is armed, in state 410, the current alarm time is displayed as steady (non-flashing) digits in the alarm time display 110. In step 407, the alarm clock 100 waits for a predetermined amount of time (e.g., 5 seconds) after the control knob 112 is rotated to set the desired alarm time, and then automatically arms the alarm function, fixes the current alarm time, and proceeds to state 410

While the alarm function is armed, in state 410, two events may occur that affect the alarm function. In the first event, in step 412, the user pushes the control knob 112, which switches the alarm function off, causes the alarm time display 110 to display the word "OFF", and returns the procedure 400 to step 402. In the second event, the current time reaches the current alarm time, the alarm function triggers, and the procedure 400 passes to step 416, wherein the alarm clock 100 emits an alarm sound.

Once the alarm has triggered and the alarm clock 100 is in step 416, another two events may occur that affect the alarm function. In the first event, in step 418, the user may push the control knob 112, which switches the alarm function off, causes the alarm time display 110 to display the word "OFF", turns off the alarm sound, and returns the procedure 400 to step 402. In the second event, in step 420, the user presses the brightness switch 114, which turns off the alarm sound. The procedure 400 then passes to step 422, wherein the alarm clock 100 waits for a predetermined amount of time (e.g., nine minutes) before returning to step 416, wherein the alarm clock 100 again emits the alarm sound.

Figure 5:
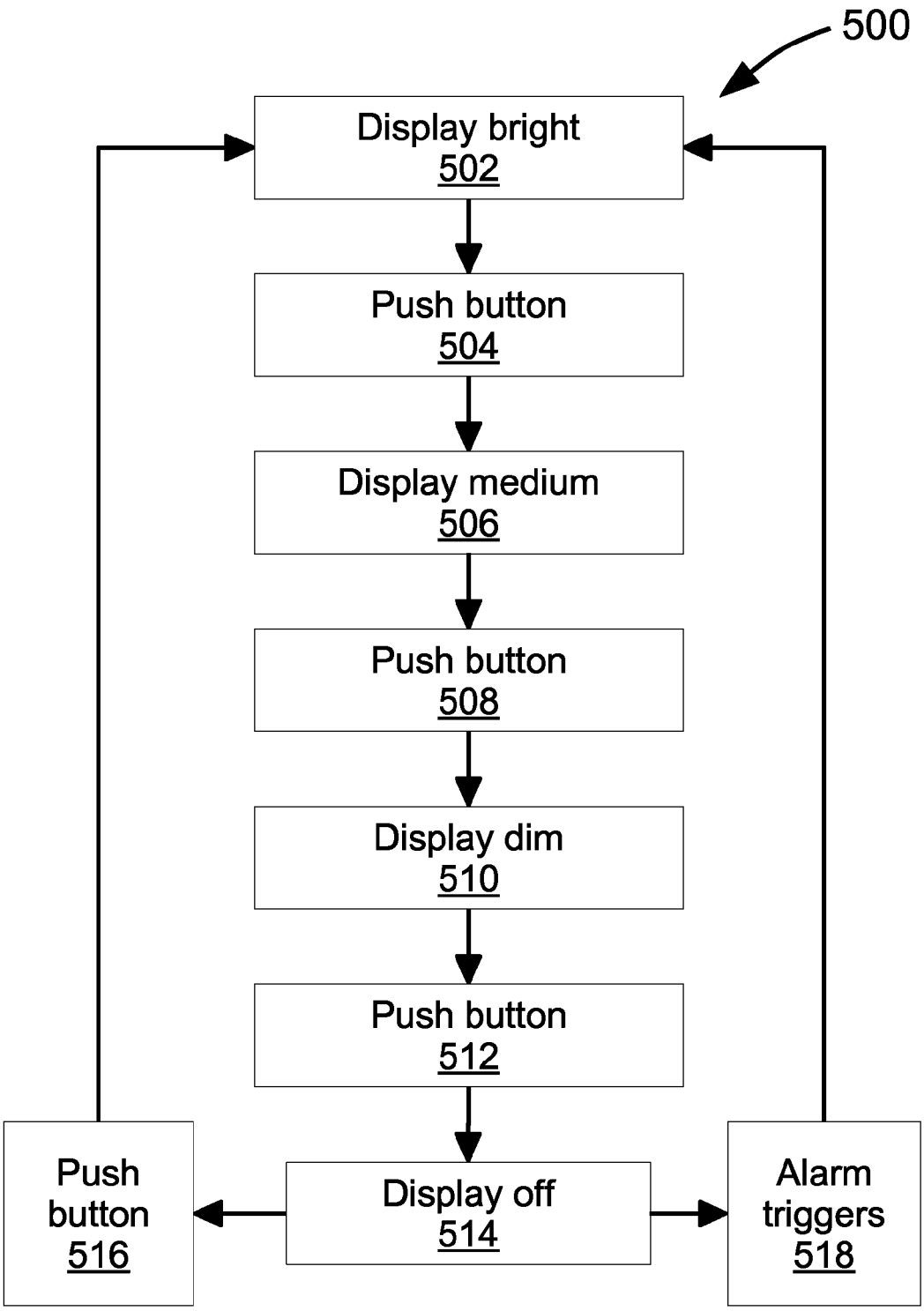
FIG. 5 presents a procedure for display brightness control of an alarm clock with charging ports according to an exemplary embodiment of the disclosure.

FIG. 5 presents a procedure 500 for display brightness control of an alarm clock with charging ports according to an exemplary embodiment of the disclosure. The procedure 500 controls brightness of the current time display 106 and, if on, the alarm time display 110. In step 502 the displays 106 and 110 are at full brightness setting. In step 504, the user presses the brightness switch 114 and the procedure 500 passes to step 506, wherein the displays 106 and 110 are at a medium brightness setting. In step 508, the user presses the brightness switch 114 and the procedure 500 passes to step 510, wherein the displays 106 and 110 are at a dim setting.

In step 512, the user presses the brightness switch 114 and the procedure 500 passes to step 514, wherein the displays 106 and 110 are turned off. Once the displays 106 and 110 are turned off in step 514, two events may occur that affect the display brightness. In a first event, in step 516, the user presses the brightness switch 114 and the procedure returns to step 502, wherein the displays 106 and 110 are at full brightness setting. In the second event, in step 518, the alarm triggers (i.e., the procedure 400 described with reference to FIG. 4 passes to step 416) and the procedure returns to step 502, wherein the displays 106 and 110 are at full brightness setting.

In other embodiments, the alarm clock 100 may have any number of brightness levels (other than off), more than or less than the three brightness levels described with reference to procedure 500.

Figure 6B:
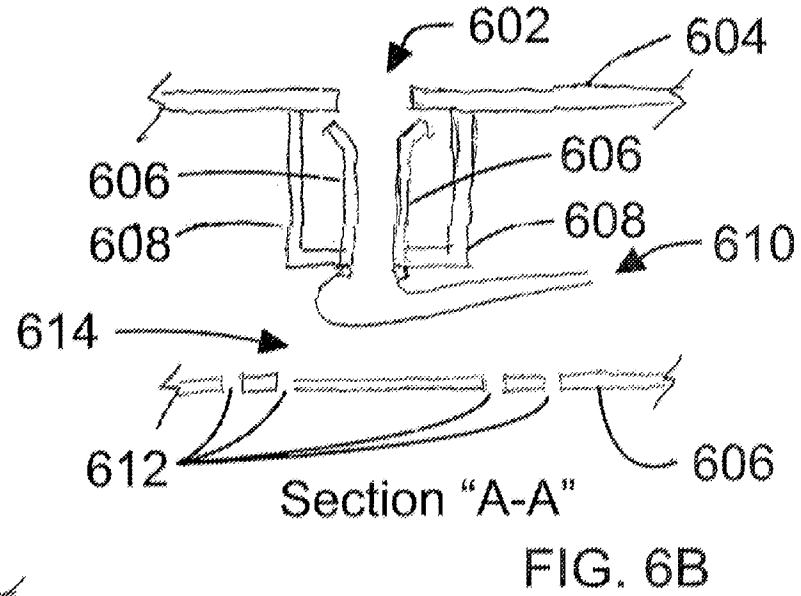
FIGS. 6A-6C present top and cross-sectional views of spill-through power outlets of an alarm clock with charging ports according to an exemplary embodiment of the disclosure in use.
Figure 6A:
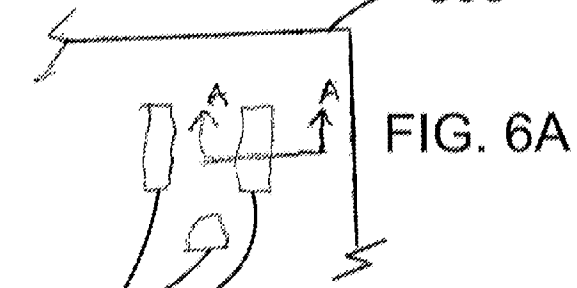

FIG. 6A present a top view of a portion of an alarm clock 600 with charging ports according to an exemplary embodiment of the disclosure. The alarm clock 600 includes a line voltage charging port 602. A section "A-A" is indicated through one of the three connector apertures of the port 602. The port 602 is referred to as a "spill-through" port, because liquids that are spilled or otherwise pass into one or more of the three apertures of the port 602 move past electrical connectors of the port 602, through the interior of the alarm clock 600, and out through drain apertures in the bottom of the alarm clock 600, as will be described in more detail with reference to FIGS. 6B and 6C.

Figure 6C:
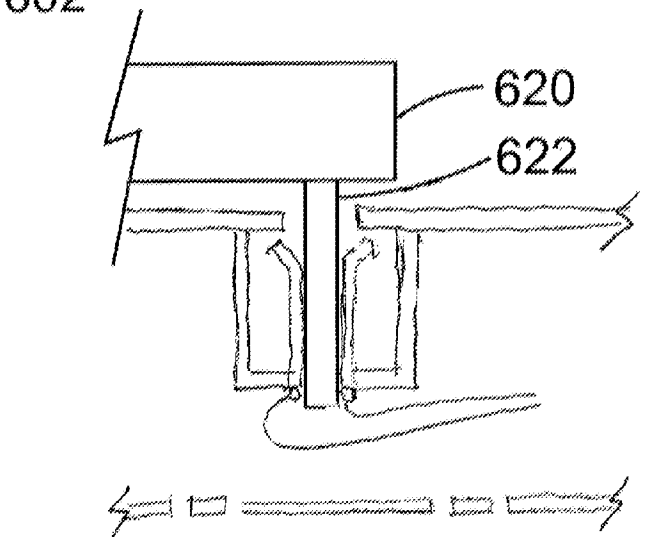

FIGS. 6B and 6C present cross-sectional views along section "A-A" of the spill-through port 602 of the alarm clock 600. A housing of the alarm clock 600 includes an upper surface 604 and a lower surface 606. The lower surface 606 includes drain apertures 612. While four drain apertures 612 are shown in the lower surface 606, it will be understood that any number of drain apertures may be used in other embodiments.

Stanchions 608 are mechanically coupled to the top 604 and support port connectors 606, which are positioned to make electrical contact with a plug connector 622 of a plug 620 inserted into the port 602. Conductors 610 are electrically coupled at a first end to the port connectors 606 and at a second end (not shown in FIG. 6B or 6C) to a power source such as power supply 208 described with reference to FIG. 2.

Liquids entering the spill-through port 602 flow over and past the port connectors 606, and into a lower region 614 of the housing of the alarm clock 600. However, rather than collecting in the lower region 614, the liquid passes out of the housing through the drain apertures 612. It will be understood that feet of the alarm clock 600 (not shown in FIGS. 6A-6C) rest on a supporting surface, raising the lower surface 606 adequately that liquid flowing out through the drain apertures 612 can flow away under the lower surface 606 on the supporting surface.

In this way, liquid entering the alarm clock 600 through the aperture 602 is prevented from rising to a level at which the liquid contacts connectors associated with one or more of the three connector apertures of the port 602, causing an electrical short-circuit between the contacted connectors. Similarly, such liquid is prevented from rising to a level at which the liquid contacts circuitry of the clock 600.

Additionally, the stanchions 608 and other mounting structures for the port connectors 606 are preferably fabricated from non-conductive material. In this way, the likelihood of the liquid forming electrical short-circuits between the port connectors 606 as it flows over the port connectors 606 is reduced or eliminated.

Figures 7, 8:
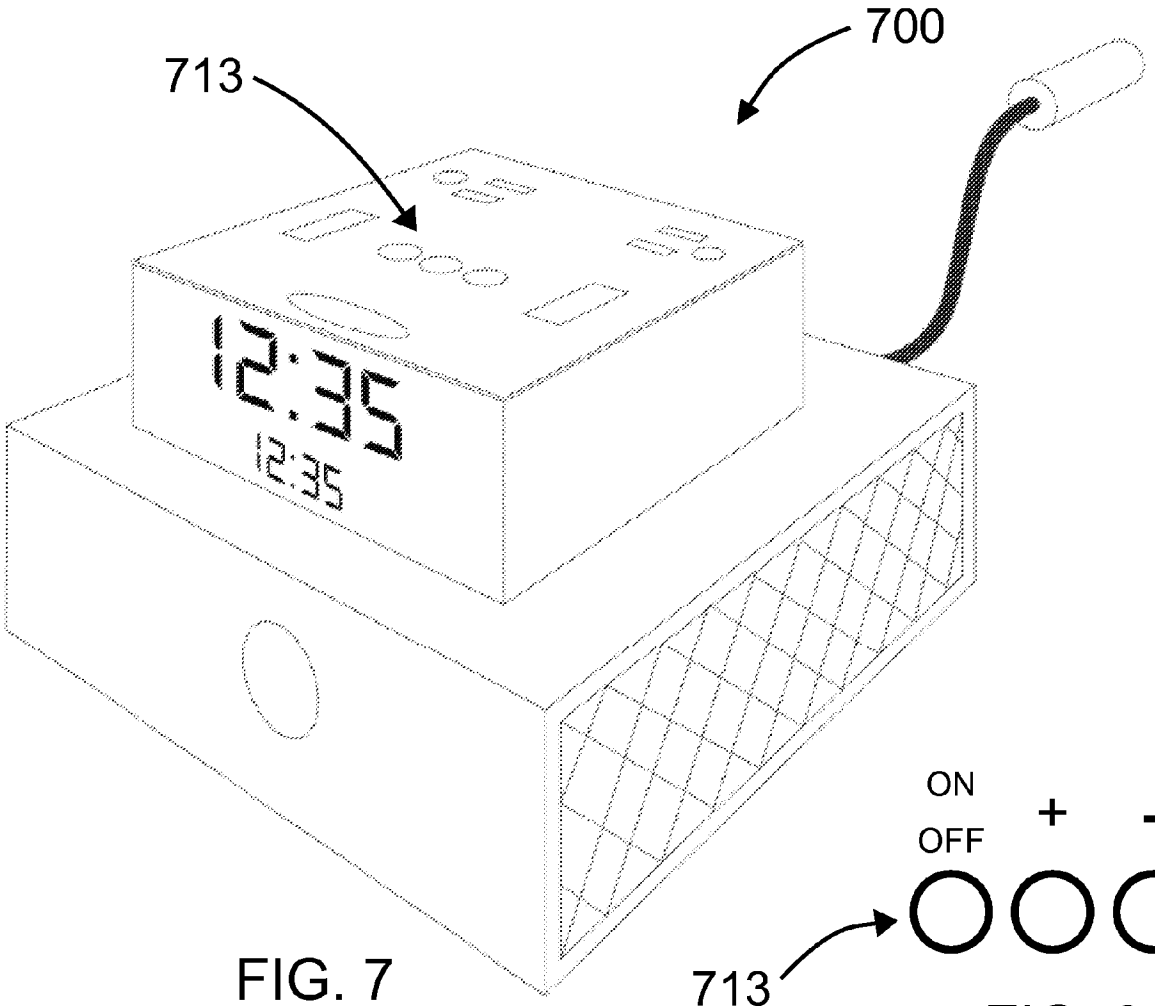
FIG. 7 presents an isometric view of an alarm clock with charging ports according to a second exemplary embodiment of the disclosure.
FIG. 8 illustrates an alarm control device according to the second exemplary embodiment of the disclosure.

FIG. 7 presents an isometric view of an alarm clock 700 with charging ports according to another exemplary embodiment of the disclosure. Most elements of the alarm clock 700 are similar to the alarm clock 100 described with reference to FIGS. 1-6C. A particular difference between alarm clock 700 and alarm clock 100 is alarm control device 713. The alarm control device 713 comprises a plurality of switches. Functions of the alarm clock 100 that are controlled by the control knob 112 are controlled in the alarm clock 700 by the plurality of switches of the alarm control device 713.

FIG. 8 illustrates the alarm control device 713 in greater detail. The alarm control device 713 comprises a first switch, labeled on/off, which provides the same control of the alarm clock 700 as the switch associated with the control knob 112 provides of the alarm clock 100. The alarm control device 713 further comprises two other switches, labeled "+" and "−", which provide the same control of the alarm clock 700 as the rotary position sensor associated with the control knob 112 provides of the alarm clock 100, when the control knob 112 is rotated in the clockwise and counter-clockwise directions, respectively.

Although the present disclosure has been described with an exemplary embodiment, various changes and modifications may be suggested to one skilled in the art. It is intended that the present disclosure encompass such changes and modifications as fall within the scope of the appended claims.

What is claimed is:

1. An alarm clock, comprising:

a housing;

one or more charging ports mounted in an upper surface of the housing, each charging port electrically coupled to a power supply and configured to provide power to an external device electrically coupled to the charging port;

one or more drain apertures formed in a lower surface of the housing;

an alarm control device, comprising first and second input devices;

a brightness switch;

a display; and a controller, electrically coupled to the alarm control device, the brightness switch, and the display and configured to receive input signals from the alarm control device and the brightness switch and to send output signals to the display, wherein the one or more drain apertures are configured to drain liquid entering the housing through the one or more charging ports without the liquid forming an electrical short-circuit between electrical connectors associated with the one or more charging ports, and the controller is configured to:

responsive to a first activation of the first input device, enter an alarm-setting mode, wherein the controller displays a desired alarm time on the display and responds to activation of the second input device by adjusting the desired alarm time;

responsive to a second activation of the first input device, arm an alarm mode;

responsive to a current time matching the desired alarm time while the alarm function is armed, cause the audio transducer to emit an alarm sound;

responsive to a third activation of the first input device, cease displaying the alarm time on the display, disarm the alarm function, and, if the alarm sound is being emitted, cease emitting the alarm sound, wherein the alarm function remains disarmed until armed again in response to a subsequent activation of the first input device;

responsive to a first activation of the brightness switch, set a brightness of the display, including turning off the display;

responsive to the current time matching the desired alarm time while the alarm function is armed and the display is turned off, to turn on the display;

responsive to a second activation of the brightness switch, the second activation lasting for a period longer than a predetermined length of time, enter a date-setting mode, wherein the controller displays a desired month on the display and respond to activation of the second input device by adjusting the desired month;

responsive to a fourth activation of the first input device, display a desired day of the month on the display and respond to activation of the second input device by adjusting the desired day of the month;

responsive to a fifth activation of the first input device, enter a time-setting mode, wherein the controller displays a desired time of day on the display and responds to activation of the second input device by adjusting the desired time of day;

responsive to a sixth activation of the first input device, set a current month to the desired month, set a current day of the month to the desired day of the month, and set the current time to the desired time of day; and responsive to the current month and day of the month matching a predetermined month and day of the month, adjust the current time to enter or exit daylight savings time.

2. The alarm clock of claim 1, further comprising a Bluetooth-compatible receiver, a pairing switch coupled to the receiver, and speakers coupled to the receiver, wherein the receiver is configured to:

respond to an activation of the pairing switch by performing a Bluetooth pairing procedure with an external audio source; and receive an audio signal from the external audio source and play the received audio signal via the speakers.

3. The alarm clock of claim 1, wherein the power supply comprises a surge protector.

4. The alarm clock of claim 1, wherein the one or more charging ports provide at least one of low voltage DC power and line voltage AC power to the external device.

5. The alarm clock of claim 1, wherein the alarm control device is one of a plurality of switches and a control knob, wherein in the plurality of switches, the first input device comprises a first switch of the plurality of switches and the second input device comprises a subset of the plurality of switches, and in the control knob, the first input device comprises a switch and the second input device comprises a rotary position encoder.

* * * * *